US007935201B2

(12) United States Patent
Uitenbroek

(10) Patent No.: US 7,935,201 B2
(45) Date of Patent: May 3, 2011

(54) NON-SLIP MASKING PRODUCT, AND METHODS

(75) Inventor: David Uitenbroek, Sun Prairie, WI (US)

(73) Assignee: Wausau Paper Mills, LLC, Mosinee, WI (US)

( * ) Notice: Subject to any disclaimer, the term of this patent is extended or adjusted under 35 U.S.C. 154(b) by 42 days.

(21) Appl. No.: 11/947,567

(22) Filed: Nov. 29, 2007

(65) Prior Publication Data

US 2008/0230166 A1 Sep. 25, 2008

Related U.S. Application Data

(60) Provisional application No. 60/867,760, filed on Nov. 29, 2006.

(51) Int. Cl.
*E04F 13/00* (2006.01)

(52) U.S. Cl. ..... 156/71; 156/60; 156/145; 156/152; 427/207.1; 427/208; 428/40.1; 428/40.2; 428/41.7; 428/41.8; 428/343; 428/354

(58) Field of Classification Search ..... 428/40.2, 428/343, 40.1, 41.7, 41.8, 141, 354; 427/207.1, 427/208; 156/60, 71, 145, 152, 247, 254, 156/280
See application file for complete search history.

(56) References Cited

U.S. PATENT DOCUMENTS

| | | | | |
|---|---|---|---|---|
| 2,730,456 | A | | 1/1956 | Green et al. |
| 2,730,457 | A | | 1/1956 | Green et al. |
| 2,768,902 | A | * | 10/1956 | Scholl ..... 156/254 |
| 2,800,457 | A | | 7/1957 | Green et al. |
| 2,800,458 | A | | 7/1957 | Green et al. |
| 3,844,718 | A | | 10/1974 | Cohen |
| 4,001,140 | A | | 1/1977 | Foris et al. |
| 4,049,121 | A | | 9/1977 | White |
| 4,081,376 | A | | 3/1978 | Strub |
| 4,087,376 | A | | 5/1978 | Foris et al. |
| 4,089,802 | A | | 5/1978 | Foris et al. |
| 4,100,103 | A | | 7/1978 | Foris et al. |
| 4,105,823 | A | | 8/1978 | Hasler et al. |
| 4,197,346 | A | | 4/1980 | Stevens |
| 4,221,710 | A | | 9/1980 | Hoshi et al. |
| 4,251,386 | A | | 2/1981 | Saeki et al. |
| 4,303,462 | A | | 12/1981 | Karr |
| 4,356,109 | A | | 10/1982 | Saeki et al. |
| 4,444,699 | A | | 4/1984 | Hayford |

(Continued)

FOREIGN PATENT DOCUMENTS

GB 2 062 570 A 5/1981

OTHER PUBLICATIONS

Lab Master Slip and Friction, http://www.testingmachines.com/pdf/32-91-lab-master-slip-friction.pdf.*

(Continued)

*Primary Examiner* — Kat Wyrozebski
*Assistant Examiner* — Joshel Rivera
(74) *Attorney, Agent, or Firm* — Merchant & Gould, P.A.

(57) ABSTRACT

A masking product having an exposed non-slip surface. In some embodiments, the masking product has two non-slip surfaces, on opposite sides of the paper. The non-slip surface exposed surfaces having an increased coefficient of friction to inhibit the movement (e.g., slipping) of items present on the non-slip surface.

18 Claims, 1 Drawing Sheet

U.S. PATENT DOCUMENTS

| | | | |
|---|---|---|---|
| 4,452,723 | A | 6/1984 | Carstens |
| 4,508,587 | A | 4/1985 | Hunter |
| 4,547,429 | A | 10/1985 | Greiner et al. |
| 4,552,811 | A | 11/1985 | Brown et al. |
| 4,588,469 | A | 5/1986 | Hunter |
| 4,622,267 | A | 11/1986 | Riecke |
| 4,651,500 | A | 3/1987 | Chaffey |
| 4,820,374 | A | 4/1989 | Lamb |
| 4,860,893 | A | 8/1989 | Kaufman |
| 4,889,759 | A | 12/1989 | Yamazaki |
| 4,906,322 | A | 3/1990 | Hollier |
| 4,909,179 | A | 3/1990 | McBride |
| 5,090,566 | A | 2/1992 | Yount |
| 5,167,322 | A | 12/1992 | Lemaire |
| 5,238,736 | A | 8/1993 | Tseng et al. |
| 5,322,731 | A | 6/1994 | Callahan, Jr. et al. |
| 5,339,957 | A | 8/1994 | Carstens |
| 5,366,085 | A | 11/1994 | Kewin |
| 5,392,585 | A | 2/1995 | Wall |
| 5,536,786 | A | 7/1996 | Callahan, Jr. et al. |
| 5,572,848 | A | 11/1996 | Wall |
| 5,625,006 | A | 4/1997 | Callahan, Jr. et al. |
| 5,642,600 | A | 7/1997 | Hooper et al. |
| 5,761,881 | A | 6/1998 | Wall |
| 5,960,608 | A | 10/1999 | Ohtonen |
| 6,013,342 | A | 1/2000 | Neto |
| 6,186,326 | B1 | 2/2001 | Pienta et al. |
| 6,347,498 | B1 | 2/2002 | Pienta et al. |
| 6,378,454 | B1 | 4/2002 | Massi |
| 6,505,459 | B1 | 1/2003 | Ruohio et al. |
| 6,592,990 | B2 | 7/2003 | Schwantes |
| 6,774,063 | B2 | 8/2004 | Bouchette et al. |
| 6,830,645 | B2 | 12/2004 | Wells et al. |
| 6,938,549 | B2 | 9/2005 | Bullock |
| 2002/0136852 | A1 | 9/2002 | Fleming |
| 2002/0150738 | A1 | 10/2002 | Bouic |
| 2002/0192406 | A1 | 12/2002 | Labbe et al. |
| 2004/0038607 | A1 * | 2/2004 | Williamson et al. ..... 442/101 |
| 2005/0004259 | A1 | 1/2005 | Freyberg et al. |
| 2005/0153085 | A1 | 7/2005 | Drummond |
| 2005/0252952 | A1 | 11/2005 | Nomula |
| 2005/0258219 | A1 | 11/2005 | Languillat et al. |
| 2005/0260365 | A1 | 11/2005 | Niu et al. |
| 2006/0182919 | A1 | 8/2006 | Howell |

OTHER PUBLICATIONS

Heat Platens, http://www.cascades-sonoco.com/english/02__products/02__06.htm, 2 pages (Date Printed Aug. 23, 2006).

Inside Headers, http://www.cascades-sonoco.com/english/02__products/02__01.htm, 2 pages (Date Printed Aug. 23, 2006).

Outside Headers, http://www.cascades-sonoco.com/english/02__products/02__02.htm, 2 pages (Date Printed Aug. 23, 2006).

Pyramid Runner Mats by MatTEch, Inc., http://www.mattechinc.com/products__runnermatting__pyramidrunner.php, 3 pages (Date Printed Nov. 11, 2006).

Ream Wrap, http://www.cascades-sonoco.com/english/02__products/02__05.htm, 1 page (Date Printed Aug. 23, 2006).

Sellocoat, http://www.cascades-sonoco.com/english/02__products/02__04.htm, 2 pages (Date Printed Aug. 23, 2006).

T9 Premier Coated Masking Paper, http://www.tnine.com/index-2.hmtl, 2 pages (Date Printed Nov. 17, 2006).

T9 Premier Tapeless Coated Masking Paper, http://www.tnine.com/index-1.html, 2 pages (Date Printed Nov. 17, 2006).

T9 Products History—How T9 Came About, http://www.tnine.com/index-4.html, 1 page (Date Printed Nov. 17, 2006).

Wrappers, http://www.cascades-sonoco.com/english/02__products/02__03.htm, 2 pages (Date Printed Aug. 23, 2006).

* cited by examiner

NON-SLIP MASKING PRODUCT, AND METHODS

This application claims priority to U.S. Provisional Application Ser. No. 60/867,760 that was filed with the United States Patent and Trademark Office on Nov. 29, 2006. The entire disclosure of U.S. Provisional Application Ser. No. 60/867,760 is incorporated by reference.

The present disclosure is directed to sheet good products, in particular, masking products, such as masking paper. The disclosure relates to masking products having a non-slip surface.

BACKGROUND

Masking products are commonly used to protect a surface during various constructions or refinishing activities. An example of such an activity where surfaces are often protected is painting. Masking products (e.g., masking papers) are often applied to adjacent surfaces to protect the surface from the paint. Because of the placement of the masking products in some activities, it is often necessary to walk or step on the masking product in order to properly complete the application. In some embodiments, the masking products are slippery, creating risky conditions for those stepping on the product.

SUMMARY

The present disclosure provides masking products having non-slip properties. Although the products of this disclosure are particularly adapted to being provided on a surface on which persons walk or step or on which items are placed, the products could also be used on non-weight bearing surfaces. The products of this disclosure provide masking properties, liquid bleed through resistance, and also have a sufficient coefficient of friction to inhibit slipping of items placed on the paper. In some embodiments, the products of this disclosure have a sufficient coefficient of friction on the top side to inhibit slipping of an item placed on the product and a sufficient coefficient of friction on the bottom side to inhibit slipping of the product itself on the surface on which it is placed.

In one particular embodiment, this disclosure is directed to a masking product that includes a paper base sheet with a non-slip coating on a first side. The non-slip coating can be formed from encapsulated material, which may be a solvent or water based material. In some embodiments, the non-slip coating is activated, e.g., by the application of heat and/or pressure, prior to use of the masking product. In some embodiments, the masking product includes a second non-slip coating on a second side opposite to the first side. The second non-slip coating may be the same or different than the non-slip coating on the first side. In some embodiments, an adhesive coating may be present on the second side opposite the first side.

In another particular embodiment, this disclosure is directed to a masking product that includes a paper base sheet having a first surface and an opposite second surface, and a first non-slip coating on the first surface, the non-slip coating being non-tacky and non-adhesive, having a horizontal plane coefficient of friction of at least about 0.4 and providing improved bleed through properties to the base sheet. The base sheet could be a paper sheet or include paper or paper fibers therein. The horizontal plane coefficient of friction may alternately be at least about 1.0 or at least about 2.0.

In another embodiment, a masking product is provided having a non-slip coating having an inclined plane coefficient of friction of at least about 22°. In some embodiments, the inclined plane coefficient of friction may be at least about 45° or at least about 70°.

To form certain products of this disclosure, a non-slip coating pre-composition, comprising encapsulated material and other optional materials, is applied to a base sheet and at least partially dried. Prior to use, the encapsulated material is activated, e.g., burst, by the application of heat and/or pressure. In some embodiments, the activation may be done simultaneously with the drying. The burst encapsulated material creates a non-tacky, non-slip coating.

In yet another particular embodiment, this disclosure is directed to methods of protecting a surface using a masking product, such as a surface to be walked on or on which objects are placed. The method includes placing a masking product having a non-slip coating on the surface to be protected, the non-slip coating being non-tacky and non-adhesive and having a horizontal plane coefficient of friction of at least about 0.4. The method could further include adhering the masking product to the surface, such as by applying a tape to edges of the masking product or by an adhesive layer on the masking product.

In another embodiment, this disclosure is directed to methods of protecting a surface during painting. The method includes placing a masking product having a non-slip coating on the surface to be protected, the non-slip coating being non-tacky and non-adhesive and having a horizontal plane coefficient of friction of at least about 0.4.

These and other embodiments are described in the present disclosure.

DETAILED DESCRIPTION

The present disclosure is directed to a masking product, for hiding surfaces, the masking product having an exposed non-slip surface. In some embodiments, the masking product has two non-slip surfaces, on opposite sides of a base sheet. The non-slip surface has an increased coefficient of friction to inhibit the movement (e.g., slipping) of items present on the non-slip surface. This coefficient of friction may be tested by a horizontal plane method or an inclined plane method.

Figure 1:
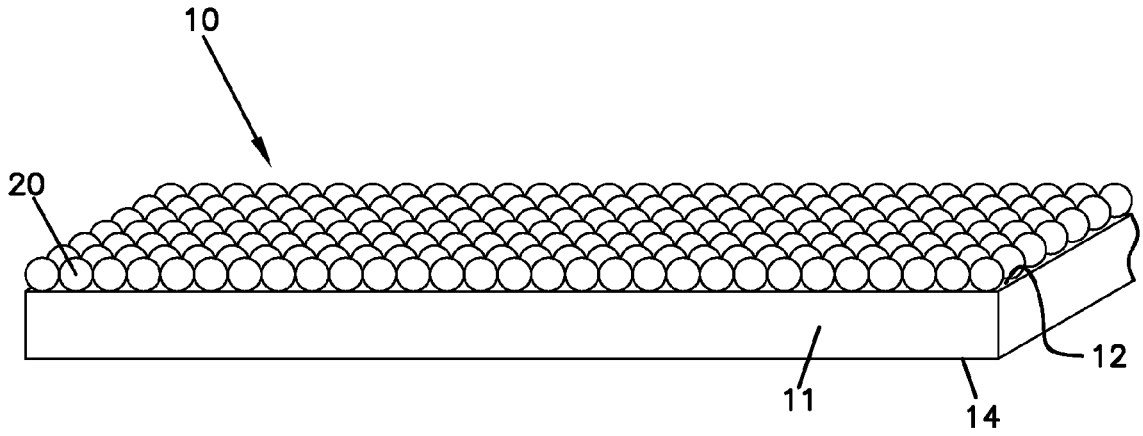
FIG. 1 is a schematic perspective side view of a first embodiment of a masking product according to the present disclosure.

The details of a masking product of the present disclosure are illustrated in the enlarged view of a non-slip masking product 10 in FIG. 1. Non-slip masking product 10 may be alternately referred to as "masking product 10" or "product 10".

Non-slip masking product 10 includes a base sheet 11 having a first surface 12 and an opposite second surface 14. A non-slip coating 20, formed from a non-slip coating pre-composition, is present on first surface 12. When installed on a surface to be protected, product 10 is positioned so that first surface 12 and non-slip coating 20 are exposed; that is, first surface 12 and non-slip coating 20 are positioned up and second surface 14 is positioned against the surface or item being protected.

Base sheet 11 can be any suitable material but is usually a paper product, such as kraft paper or paperboard. Polymer based materials, which may be a laminate of paper and polymer, or all polymer, are also suitable materials for base sheet 11. If base sheet 11 includes paper, masking product 10 can be referred to as a masking paper.

Base sheet 11 should be sufficiently durable to withstanding walking or stepping on masking product 10 or movement of objects on product 10, yet sufficiently flexible so that it can be conveniently stored, applied to a surface, and optionally secured to (e.g., taped to) the surface being protected. Although one example of a suitable base sheet 11 is 42 pound unbleached kraft paper (i.e., a 1000 square feet weighs 42 pounds), base sheets of about 5 to about 200 pounds per 1000 square feet could be used. In some embodiments, base sheet 11 has a basis weight of about 20 to about 100 pounds per 1000 square feet, and in some embodiments, a basis weight of about 30 to about 70 pounds per 1000 square feet. A 55 pound (per 1000 square feet) kraft paper is another example of a suitable base sheet 11, as is a 69 pound (per 1000 square feet) kraft paper.

Base sheet 11, if a paper product, can include natural fiber, synthetic fiber, or a mixture.

Natural fiber refers to fiber formed from plants or animals. Natural fibers are not fibers that are formed as a result of extrusion or spinning. The natural fibers can be obtained from a fiber source using techniques such as chemical pulping, chemical mechanical pulping, semi chemical pulping, or mechanical pulping. Natural fibers from plants are often referred to as cellulosic fibers. Exemplary natural fibers that can be used to form base sheet 11 include wood fibers and non-wood natural fibers such as vegetable fibers, cotton, various straws (e.g., wheat and rye), various canes (e.g., bagasse and kenaf), silk, animal fiber, (e.g., wool), grasses (e.g., bamboo, etc.), hemp, corn stalks, abaca, etc.

Wood fiber can be obtained from wood pulp, which can include hardwood fibers, softwood fibers, or a blend of hardwood fibers and softwood fibers. The pulp can be provided as cellulose fiber from chemical pulped wood, and can include a blend from coniferous and deciduous trees. By way of example, wood fibers can be from northern hardwood, northern softwood, southern hardwood, southern softwood, or any blend thereof. Hardwood fibers tend to be more brittle but are generally more cost effective for use because the yield of pulp from hardwood is higher than the yield of pulp from softwood. Softwood fibers have desired paper making characteristics but are generally more expensive than hardwood fibers.

The natural fibers can be extracted with various pulping techniques. For example, mechanical or high yield pulping can be used for stone ground wood, pressurized ground wood, refiner mechanical pulp, and thermomechanical pulp. Chemical pulping can be used incorporating kraft, sulfite, and soda processing. Semi-chemical and chemi-mechanical pulping can also be used which includes combinations of mechanical and chemical processes to produce chemi-thermomechanical pulp. Natural fibers can be bleached or unbleached.

The pulp can include a recycle source for reclaimed fiber. Exemplary recycle sources include post-consumer waste (PCW) fiber, office waste, and corrugated carton waste. Post-consumer waste fiber refers to fiber recovered from paper that is recycled after consumer use. Office waste refers to fiber obtained from office waste, and corrugated carton waste refers to fiber obtained from corrugated cartons. Additional sources of reclaimed fiber include newsprint and magazines. Reclaimed fiber can include both natural and synthetic fiber. Incorporation of reclaimed fiber in base sheet 11 can aid in efficient use of resources and increase satisfaction of the end user of masking product 10.

Examples of synthetic fibers that could be used for base sheet 11 include polyacrylic fiber, polyethylene fiber, polypropylene fiber, polylactide fiber, rayon, and nylon fiber.

Non-slip coating 20 on base sheet 11 is a coating that provides sufficient frictional properties to product 10 to inhibit an item or person from slipping on or off of masking product 10. The frictional properties of non-slip coating 20 can be measured by various methods, including a Horizontal Plane Method and an Inclined Plane Method.

For product 10, when using the Horizontal Plane Method, as defined by TAPPI test method T816 entitled "Coefficient of Static Friction of Corrugated and Solid Fiber Board (Horizontal Plane Method)", coating 20 can have a static coefficient of friction of at least about 0.4. In some embodiments, the static coefficient of friction can be at least about 1 (e.g., at least about 1.0), at least about 2 (e.g., at least about 2.0), and even at least about 3 (e.g., at least about 3.0). In yet another aspect, the static coefficient of friction for non-slip coating 20 is at least about 0.8 and preferably at least about 1.

For product 10, when using the Inclined Plane Method, as defined by TAPPI test method T815 "Coefficient of Static Friction (slide angle) of Packaging and Packaging Materials (including shipping sack papers, corrugated and solid fiberboard) (Inclined Plane Method)", non-slip coating 20 can have a static coefficient of friction of at least about 22°, at least about 45°, or at least about 70°.

Non-slip coating 20, in addition to having the desired coefficient of friction, is non-adhesive and non-tacky to the touch. Whether or not a coating or product is non-tacky can be determined by a Vertical Wall Test. In the Vertical Wall Test, an item having a non-tacky surface, when applied to a vertical stainless steel surface at room temperature, will not stick or adhere to that surface, but will immediately fall away after any external force holding the item to the surface is removed. An item having an adhesive or a tacky surface will remain attached to the stainless steel surface for an amount of time after any external holding force is removed.

In some designs, non-slip coating 20 provides additional features to product 10 in addition to providing an increased friction surface. For example, coating 20 increases the bleed through resistance of a liquid, such as paint, through base sheet 11 and thus through masking product 10. Non-slip coating 20 improves the bleed through resistance by providing a layer, preferably free of pin holes, across surface 12 of base sheet 11.

The 'bleed through' resistance or properties of product 10 can be tested by the Bleed Through Test, in which a puddle (approx. 2 oz) of aggressive enamel paint (such as that available from Dupli-Color Products Co. under the designation "Engine Enamel with Ceramic", which is used for painting engine blocks) is applied onto non-slip coating 20 of product 10. The opposite side of product 10, i.e., surface 14, is watched for any discoloration that would indicate base sheet 11 being wetted by the paint. When dried, the paint preferably adheres to coating 20 without flaking off. In products having poor bleed through properties, the wet paint will soak through and sometimes even stain the surface being protected.

Non-slip coating 20 may also impart water resistance or water proofness to product 10. Depending on the specific coating 20, water may merely bead on coating 20.

Various materials can be used for to form non-slip coating pre-composition (which, when dried forms non-slip coating 20). Encapsulated materials (which include microencapsulated materials) are one class of suitable, and preferred, materials. The material, when burst, provides a non-tacky, non-slip surface having a desired static coefficient of friction.

Encapsulated materials are beneficial in that they facilitate the coating and converting process, as compared to non-encapsulated materials. Encapsulated materials are easier to mix, coat, and otherwise process conventional process equipment. It is generally not necessary to adjust for non-slip or frictional materials (e.g., there is generally no need for special dryers, converting equipment, etc.).

As a simple description, encapsulated materials have a shell or capsule surrounding a frictional material, such as a polymeric material. Encapsulated materials and methods for making them are well known. For example, U.S. Pat. Nos. 2,730,456, 2,800,457, and 2,800,458 describe methods of capsule formation. Other useful methods for microcapsule manufacture are described in U.S. Pat. Nos. 4,001,140, 4,081,376 and 4,089,802, which describe a reaction between urea and formaldehyde; U.S. Pat. No. 4,100,103 describes a reaction between melamine and formaldehyde; British Patent No. 2,062,570 describes a process for producing microcapsules having walls produced by polymerization of melamine and formaldehyde in the presence of a styrenesulfonic acid. Microcapsules are also taught in U.S. Pat. Nos. 2,730,457 and 4,197,346. Microcapsules from urea-formaldehyde resin and/or melamine formaldehyde resin are disclosed in U.S. Pat. Nos. 4,001,140, 4,081,376, 4,089,802, 4,100,103, 4,105,823, and 4,444,699, and alkyl acrylate-acrylic acid copolymer capsules are taught in U.S. Pat. No. 4,552,811. U.S. Pat. No. 4,622,267 discloses an interfacial polymerization technique, and a similar technique is disclosed in U.S. Pat. No. 4,547,429. Numerous other methods of encapsulation are described in U.S. Pat. No. 4,552,811, U.S. Pat. Nos. 4,001,140, 4,087,376, and 4,089,802, U.S. Pat. No. 4,100,103, U.S. Pat. No. 4,221,710, and in U.S. Pat. Nos. 4,251,386 and 4,356,109. Encapsulation using gelatin is also well known; see for example, U.S. Pat. Nos. 2,800,457 and 2,800,458 and U.S. Pat. No. 2,730,456. Each patent named is incorporated herein by reference to the extent each provides guidance regarding encapsulation processes and materials.

Other classes of suitable materials for non-slip coating pre-composition include those generally described as low-tack adhesives or pressure-sensitive adhesives, which could be encapsulated.

The encapsulated material may be water based or solvent based. Examples of suitable levels of solids may be, for example, about 25%, about 35%, about 45% or about 50%. In some embodiments, the encapsulated material may be a 100% solids material (e.g., a hot melt material).

One example of a suitable encapsulated material is acrylic polymer. For example, an encapsulated activated acrylic polymer is commercially available from Press Color, Inc. of Appleton, Wis. under the designation "Stop Slip", which is generally described as a thermo expandable waterborne ink at 45% solids.

The non-slip coating pre-composition and/or non-slip coating 20 may include filler materials or other additives in addition to the encapsulated material. For example, silica, talc, calcium carbonate or other particulate material could be present in non-slip coating pre-composition, for example to increase the static coefficient of friction of non-slip coating 20. In preferred embodiments, non-slip coating pre-composition and non-slip coating 20 are generally free of abrasive particles, such as aluminum oxide, silicon carbide and garnet. Abrasive particles or other hard particles could be knocked loose from the coating and eventually scratch the surface being protected.

The non-slip coating pre-composition can be applied to first surface 12 by conventional coating processes, such as by flood coating, saturation coating (e.g., with a metering rod), knife coating, gravure coating, reverse angle gravure coating, printing, and the like, and then appropriately dried or cured. A size coat or other undercoating may be present on first surface 12 prior to applying the non-slip coating pre-composition. Indicia or other markings could be applied to surface 12 prior to applying non-slip coating pre-composition.

Coating speeds for application of the non-slip coating pre-composition onto base sheet 11 include speeds of about 100 ft/min, and up to even about 1000 ft/min. It is understood that in many embodiments the coating speed will be dependent on the equipment, base sheet 11 and coating material used. The non-slip coating pre-composition may be a solid coating across base sheet 11 or may be a pattern coating, either contiguous or not. Whether a solid coating or pattern coating, it is preferred that the density or weight of the coating is generally consistent across masking product 10.

After application of the non-slip coating pre-composition to base sheet 11, the non-slip coating pre-composition is dried. Suitable drying methods include ovens (e.g., convention oven, tunnel oven) and heated cans. The temperature for drying the non-slip coating pre-composition is sufficient to dry or flash off any solvents from the non-slip coating pre-composition. In some embodiments, it is desired to dry the pre-composition and form the non-slip coating without activating the encapsulated material. Although the drying temperatures will depend on the exact non-slip coating pre-composition, exemplary drying temperatures are about 120° F. to about 150° F. In other embodiments, it is desired to activate the encapsulated material simultaneously with drying the pre-composition. Again, although the activation temperatures will depend on the exact non-slip coating pre-composition, exemplary temperatures are about 150° F. to about 190° F. Preferably the temperature does not exceed a temperature where the encapsulated material would degrade.

The amount of non-slip coating pre-composition applied to first surface 12 is an amount sufficient to provide non-slip coating 20 with a weight of about at least 1 pound per 1000 square feet, often at least about 2 pounds per 1000 square feet, but generally no more than about 15 pounds per 1000 square feet, and in some embodiments no more than about 10 pounds per 1000 square feet. Although sample coating weights for non-slip coating 20 are provided, it is understood that any weight of coating 20 to obtain the desired coefficient of friction would be suitable. One exemplary coating weight is about 2.3 pounds per 1000 square feet.

If needed, the activation of the non-slip properties of the coating materials, e.g., the encapsulated material, to form the non-slip, increased friction surface, can be done before or after applying masking product 10 to the surface to be protected. In most embodiments, however, it is preferred to activate the non-slip properties prior to application to the surface being protected. For encapsulated materials, the activation can be done by the application of heat and/or pressure. Additionally, the activation can be done after or simultaneously with the drying of the non-slip coating pre-composition.

It should be understood that in some embodiments, some capsules or microcapsule may remain unburst, even after the activation step. A sufficient amount of encapsulated material should burst to provide the desired non-tacky, non-slip surface.

In use, masking product 10 can be secured to the surface to be protected by a separate adhesive (e.g., strips of masking tape along the edges to secure product 10 to the surface) or by, for example, an adhesive coating (e.g., pressure sensitive adhesive coating) present on second surface 14 opposite non-slip coating 20. A release liner could be positioned over an adhesive coating until ready to be adhered to the surface to be protected. Preferably, any material present on second surface 14 includes no abrasive particles or other elements that might damage the surface being protected.

Figure 2:
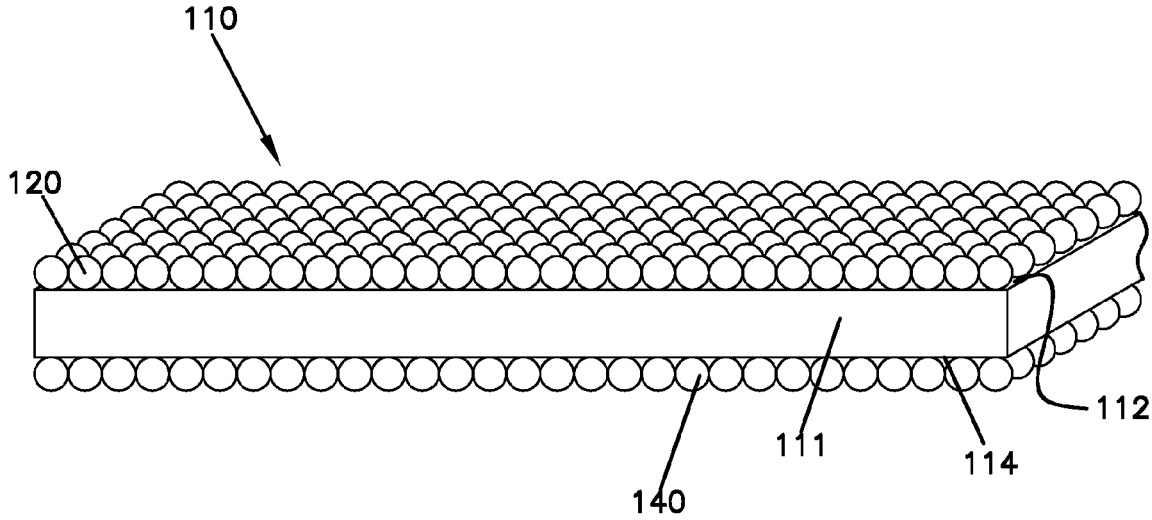
FIG. 2 is a schematic perspective side view of a second embodiment of a masking product according to the present disclosure.

Returning to the Figures, an alternate embodiment of a masking product of this disclosure is shown. In FIG. 2, non-slip masking product 110 includes a base sheet 111 having a first surface 112 and an opposite second surface 114. A non-slip coating 120 is present on first surface 112. When installed on a surface to be protected, product 110 is positioned so that first surface 112 and non-slip coating 120 are exposed; that is, first surface 112 and non-slip coating 120 are positioned up. Second surface 114 is toward the surface being protected. The various features and elements of product 110 can be similar to those of the first embodiment, non-slip masking product 10, and discussion about the features and element of non-slip masking product 10 apply to the features and elements of non-slip masking product 110.

Non-slip masking product 110 additionally includes a coating 140 present on second surface 114. When installed on a surface to be protected, product 110 is positioned so that second surface 114 is positioned against the surface or item being masked. Coating 140 may be a non-slip coating, and may be the same as or different than coating 120, for example, in coefficient of friction, coating weight, coating pattern, or material used. Printing (e.g., indicia) or a color difference between surface 112 and surface 114 may be used to differentiate between the two sides.

Non-slip masking products 10, 110 of this disclosure are particularly suited for masking applications where an item might be placed or set on the product. One particular example is in automobile painting. When painting a portion of an automobile (e.g., a side panel), the portion not being painted (e.g., an adjacent hood or trunk lid) is generally hidden by masking product. Depending on the location of the masked portion and the portion to be painted, the worker may place items on the masked portion. Sometimes, these masked portions may have a sloped or inclined surface; for example, both the hood and the trunk may have a generally downward slope. Having a non-slip surface on the top side, e.g., coating 20 on surface 12 or coating 120 on surface 112, inhibits slipping of the item. Having a non-slip surface on the bottom side, e.g., coating 140 on surface 114, increases the stability of the masking product on the surface and decreases the likelihood of the masking product slipping. Further, coating 20, 120 inhibits and preferably eliminates paint bleed through to the masked surface.

Non-slip products 10, 110 are also suited for inhibiting slippage or sliding of objects or items on flat surfaces. For examples, products 10, 110 could be used a base or liner in a truck trailer, as a liner for a food tray or surgical tray, or on a pallet to stabilize the load during transport. Products 10, 110 could be positioned between stacked levels of products (e.g., as an interleaver) to stabilized stacked loads.

Products 10, 110 of this disclosure are also particularly suited for masking applications where a person may need to stand on or step on the paper. One particular example is in aircraft painting projects. When painting a portion of a wing of an aircraft, the portion not being painted or immediately painted (e.g., that had been previously painted) is generally hidden by the masking product. Depending on the location of the masked portion and the portion to be painted, the worker may need to step on the masked portion in order to safely and adequately reach all areas of the portion to be painted. Having a non-slip surface on the top side, e.g., coating 20 on surface 12 or coating 120 on surface 112, inhibits slipping of the worker and improves his traction on the aircraft wing. Having a non-slip surface on the bottom side, e.g., coating 140 on surface 114, increases the stability of the masking product on the aircraft wing and decreases the likelihood of the paper slipping. Further, coating 20, 120 inhibits and preferably eliminates paint bleed through to the masked surface.

Non-slip products 10, 110 of this disclosure are also suited for protecting surfaces where a person may stand on or step on the paper. For example, products 10, 110 could be used to protect surfaces (e.g., hardwood floors) in high traffic areas.

One exemplary method for producing product 110 is described below.

A web of material, i.e., an extended length of material that forms base sheet 111, is provided to a coater or coating line. Typical widths (i.e., in the transverse direction) for the base sheet web are 15 to 80 inches, although webs as wide as 140 inches could be used. A preferred web is unbleached 42 pound kraft paper.

A non-slip coating pre-composition comprising encapsulated material is applied to first surface 112 of the web. An aqueous mixture of activated acrylic polymer, described as about 45% solids encapsulated material, available from Press Color, Inc. of Appleton, Wis. under the designation "Stop Slip", is diluted to about 25% solids with water and is applied to first surface 112 by a saturation coating technique using a smooth applicator roll and metering rod positioned below the web surface being coated. The aqueous mixture is transferred from the applicator roll to the surface 112 at a thickness that, when dried, provides a coating weight of about 2.3 pounds per 1000 square feet.

The aqueous mixture is dried by passing the coated web through a drying oven to flash off the water and elevate the material to at least about 130° F., sometimes to at least about 150° F., resulting in non-slip coating 120. At this temperature, the coating is dried but the non-slip material is not activated. Additionally or alternately, the coated web could be passed over/under heated can rollers.

The same non-slip coating pre-composition comprising encapsulated material is applied to second surface 114 of the web opposite first surface 112 and coating 120 by the saturation coating technique. The aqueous mixture is transferred from the applicator roll to the surface 114 at a thickness that, when dried, provides a coating weight of about 2.3 pounds per 1000 square feet. The aqueous mixture is dried in the same manner as the first coating 120 to form second coating 140.

In another embodiment, the non-slip coating pre-composition forming coating 140 may be applied to the web simultaneously, i.e., on the same coating line, as the non-slip coating pre-composition forming coating 120. In yet another embodiment, coating 140 may be subsequently applied but prior to drying of coating 120.

After non-slip coating 120 and non-slip coating 140 are present on the web, the web is converted (e.g., die cut, slit or punched) to the desired size.

Non-slip coatings 120, 140 may be activated (e.g., the capsules burst) during the drying step (e.g., by providing a web temperature of about 150° F. to about 190° F. by the drying oven or heated cans). At this temperature, the mixture is dried and the encapsulated material is activated, by bursting of the capsules. Alternately, non-slip coatings 120, 140 may be activated in a separate step, subsequent to drying of the coatings.

The above specification, examples and data provide a complete description of the manufacture and use of the composition of the invention. Since many embodiments of the invention can be made without departing from the spirit and scope of the invention, the invention resides in the claims hereinafter appended.

What is claimed:

1. A method of protecting a surface to be walked on, comprising:

placing a masking product having a first non-slip coating and a second non-slip coating over a surface to be walked on so that the first non-slip coating is positioned upwardly facing, the first non-slip coating and a second non-slip coating each having a horizontal plane coefficient of friction of at least about 0.4 as determined by TAPPI T816 and being non-tacky as determined by a Vertical Wall Test wherein the non-slip coating on the masking product will not stick or adhere to a vertical stainless steel surface at room temperature;

(i) the masking product comprising a paper sheet having a basis weight of about 5 to about 100 pounds per 1,000 square feet;

(ii) the first non-slip coating provided from an encapsulated material activated by bursting the encapsulated material;

(iii) the first non-slip coating being provided on a first side of a paper sheet and the second non-slip coating being provided on a second, opposite, side of the paper sheet; and walking on the masking product.

2. The method of claim 1 wherein the masking product is placed in close proximity to a surface to be painted.

3. The method of claim 1, wherein the paper sheet has a basis weight of about 20 to about 100 pounds per 1000 square feet.

4. The method of claim 1, wherein the first non-slip coating has a coating weight of at least about 1 pound per 1000 square feet.

5. The method of claim 1, wherein the first non-slip coating has a coating weight of at least about 2 pounds per 1000 square feet.

6. The method of claim 1, wherein the second non-slip coating is the same as the first non-slip coating.

7. The method of claim 1 wherein the first non-slip coating has a horizontal plane coefficient of friction of at least about 1 as determined by TAPPI T816.

8. The method of claim 1, wherein the first non-slip coating has a horizontal plane coefficient of friction of at least about 2 as determined by TAPPI T816.

9. The method of claim 1, wherein the first non-slip coating has an inclined plane coefficient of friction of at least about 22° as determined by TAPPI T815.

10. The method of claim 1, wherein the first non-slip coating has an inclined plane coefficient of friction of at least about 45° as determined by TAPPI T815.

11. The method of claim 1, wherein the first non-slip coating has an inclined plane coefficient of friction of at least about 70° as determined by TAPPI T815.

12. The method of claim 1, wherein the first non-slip coating is free of abrasive materials.

13. The method of claim 1, wherein the first non-slip coating is free of aluminum oxide, silicon carbide, and garnet.

14. The method of claim 1, further comprising securing the masking product by applying strips of masking tape along edges of the masking product.

15. A method of protecting a surface to be walked on, comprising:

placing a masking product having a non-slip coating over a surface to be walked on so that the non-slip coating is positioned upwardly facing, the non-slip coating having a horizontal plane coefficient of friction of at least about 0.4 as determined by TAPPI T816 and being non-tacky as determined by a Vertical Wall Test wherein the non-slip coating on the masking product will not stick or adhere to a vertical stainless steel surface at room temperature;

(i) the masking product comprising a paper sheet having a basis weight of about 5 to about 100 pounds per 1,000 square feet; and (ii) the non-slip coating provided from an encapsulated material activated by bursting the encapsulated material; and (iii) the masking product includes an adhesive coating on the paper sheet opposite the non-slip coating; wherein the step of placing comprises adhering the adhesive coating to the surface to be walked on; and walking on the masking product.

16. The method of claim 15, wherein the masking product further comprises a release liner over the adhesive coating prior to the step of placing.

17. The method of claim 15, wherein the adhesive coating includes no abrasive particles.

18. The method of claim 15, wherein the adhesive coating comprises a pressure sensitive adhesive.

* * * * *